United States Patent [19]

Weatherby et al.

[11] 4,092,007

[45] May 30, 1978

[54] STRIP ACCUMULATOR

[75] Inventors: Robert G. Weatherby, Northfield; Anthony C. Costello, Strongsville, both of Ohio

[73] Assignee: Kent Corporation, North Royalton, Ohio

[21] Appl. No.: 799,438

[22] Filed: May 23, 1977

[51] Int. Cl.[2] ..... B65H 17/48

[52] U.S. Cl. ..... 242/55; 242/55.19 R

[58] Field of Search ..... 242/55, 55.19 R, 68.7, 242/78.1; 226/118, 119

[56] References Cited

U.S. PATENT DOCUMENTS

| | | | |
|---|---|---|---|
| 3,868,065 | 2/1975 | Maruszczak | 242/55 |
| 3,999,718 | 12/1976 | Ziemba | 242/55 |

FOREIGN PATENT DOCUMENTS

| | | | |
|---|---|---|---|
| 315,292 | 2/1934 | Italy | 242/68.7 |

*Primary Examiner*—Harvey C. Hornsby
*Assistant Examiner*—John M. Jillions
*Attorney, Agent, or Firm*—Hamilton, Renner & Kenner

[57] ABSTRACT

A strip accumulator includes a frame and means for forming and supporting outer and inner sets of convolutions of strip material. The means forming the outer set of convolutions includes a flexible band which carries rollers thereon, the band being mounted to the frame in such a manner that as the convolutions of strip build up against the rollers, the band will expand. The means forming the inner set of convolutions includes arcuate plates which carry rollers thereon against which the convolutions of strip are formed. Means are provided to move the plates toward and away from each other.

20 Claims, 5 Drawing Figures

STRIP ACCUMULATOR

BACKGROUND OF THE INVENTION

This invention relates to a strip accumulator for use in a continuous processing line. More particularly, this invention relates to a strip accumulator which holds inner and outer convolutions of strip material, the convolutions being defined by inner and outer roll baskets.

Industrial processing lines which utilize a strip material, such as a metallic strip material, as an input usually require that the strip be continually fed thereto. The input strip is usually fed from a supply coil to the processing line and because it would be highly undesirable to stop the processing line upon depletion of a coil, strip accumulators, such as that shown in U.S. Pat. No. 3,506,210, are placed between the supply coil and the processing line. These accumulators receive strip from the supply coil, hold or store a quantity of the same and at the same time pay out strip so held to the processing line. Such accumulators are thus intended to permit the processing line to remain active, utilizing strip stored in the accumulator, during the time a new supply coil is attached, as by welding, to the end of a coil which has just been depleted.

In these prior art accumulators, such as U.S. Pat. No. 3,506,210, inner and outer convolutions of strip material are defined by inner and outer sets of rollers. These rollers are oriented generally in a circular configuration and as the strip builds up against them, they are designed to move radially to maintain proper spacing between the convolutions.

The manner in which the prior art has accomplished this radial expansion has not been totally satisfactory, particularly economically, since the design is quite complex, having a number of parts with attendant maintenance problems. In the prior art the shafts of the inner set of rollers are supported on one end by a linkage arrangement and extend through guide slots in a heavy backing plate. Through a linkage arrangement for each roller, rotation of a disk by a pneumatic cylinder moves the rollers radially. Such an arrangement not only includes hundreds of moving parts and heavy support structure, but it also is subject to severe bending stresses because of the cantilever construction.

In some prior art designs the outer set of rollers are mounted much like the inner set construction just described, that is, movable in a track formed in the backing plate with attendant linkages and the like. In the design of U.S. Pat. No. 3,506,210, the outer set of rollers are cantileverly extended from arms which are affixed to rotatable sleeves. The sleeves include a sprocket so that a chain actuated by a pneumatic cylinder will rotate all the sleeves to move the rollers. This design suffers from the same problems including the multiplicity of parts and cantilever construction, as discussed previously.

Another problem in prior art accumulators is their requirement to have a separate guide system for the sides of the strip, again calling for a number of complex parts. Usually the strip in both the inner and outer convolutions is maintained laterally positioned by two sets of rollers, each set contacting one edge of the strip. These edge guides are usually journalled in brackets extending from the backing plate with the brackets being slotted so that the position of the rollers may be adjusted to accommodate strip of varying widths.

In short as to the prior art accumulators, the guiding and accumulating functions are accomplished by a complex design requiring a number of moving parts all supported, in one way or another, by a heavy backing plate which itself must be precision machined to include a plurality of tracks or guide slots. As such, these accumulators are expensive to manufacture and maintain, thereby rendering them economically feasible at best only for large installations.

SUMMARY OF THE INVENTION

It is thus a primary object of the present invention to provide a strip accumulator which is simple in design having less parts and maintenance problems and yet one which will efficiently handle and store strip material.

It is another object of the present invention to provide a strip accumulator, as above, in which inner and outer convolutions of strip material are formed on expandable rollers without each individual roller being provided with complex linkage and arm arrangements to effect the expansion.

It is a further object of the present invention to provide a strip accumulator, as above, which eliminates the need for a heavy backing plate to carry the rollers which define the supports for the inner and outer convolutions of strip material.

It is yet another object of the present invention to provide a strip accumulator, as above, in which the rollers defining the supports for the inner and outer convolutions of strip material are supported at both ends thereby obviating the bending stresses occasioned by the cantilever construction.

It is a still further object of the present invention to provide a strip accumulator, as above, in which the guide means for the edges of the strip material are associated with the supporting structure for the inner and outer convolutions of strip material rather than being a separate guiding system.

These and other objects of the present invention which will become apparent from the description to follow, are accomplished by the improvements hereinafter described and claimed.

In general, the strip accumulator according to the concept of the present invention includes a frame member, means forming an outer set of convolutions of strip material and means forming an inner set of convolutions of the strip material. The means forming the outer set of convolutions includes a flexible band which carries rollers to contact the first outer convolution of the strip material. The band is mounted on the frame member in such a manner that it can be expanded as the convolutions build up, the expansion having a radial component along substantially the entire length of the band. The means forming the inner set of convolutions includes arcuate support members having rollers mounted thereon to contact the first inner convolution of the strip material. Means are provided to move the plate member toward and away from each other dependent on the number of inner convolutions.

DESCRIPTION OF THE PREFERRED EMBODIMENT

Figure 1:
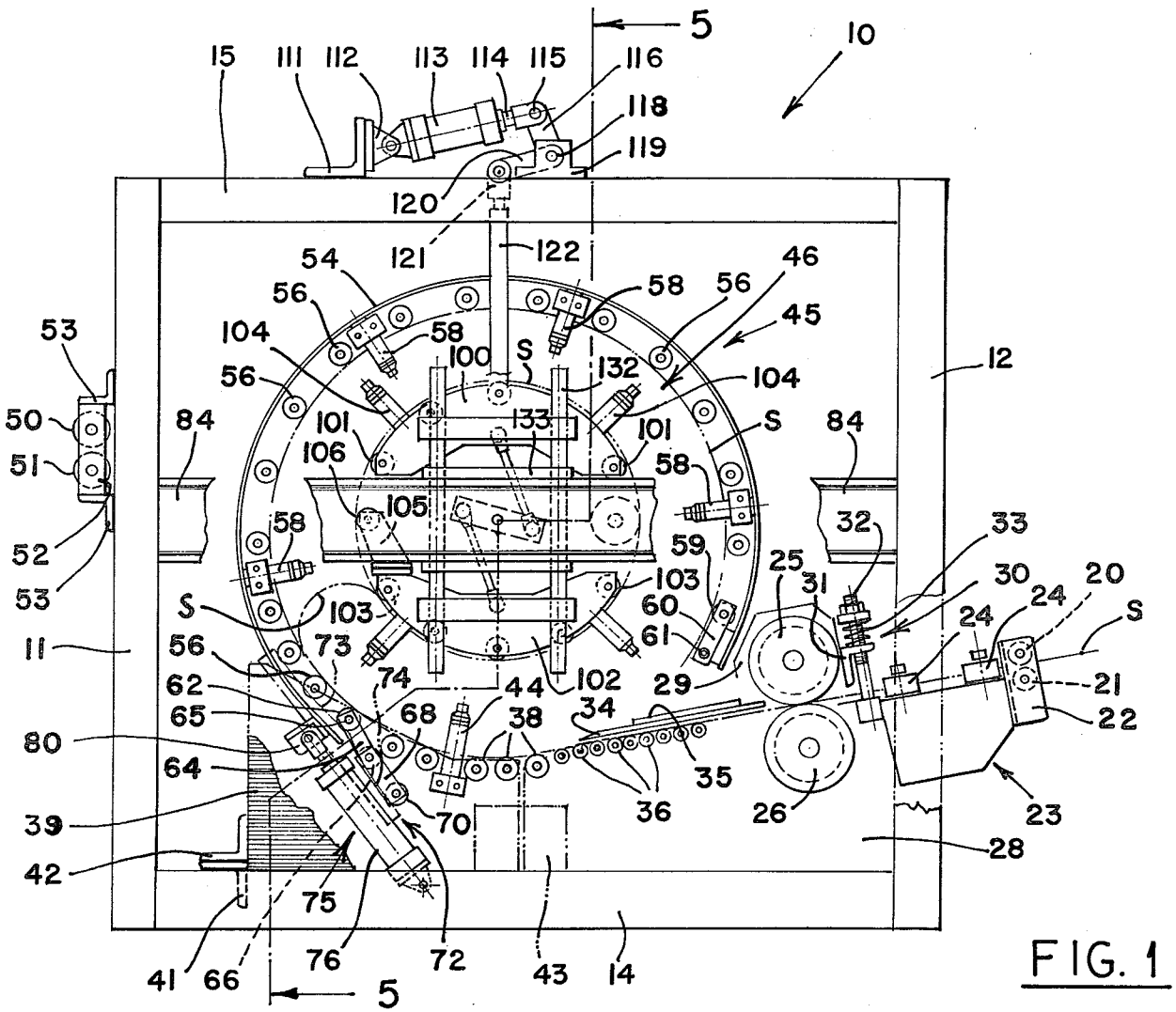
FIG. 1 is a somewhat schematic elevational view of the strip accumulator according to the concept of the present invention having some parts brocken away and some parts omitted for clarity.
Figure 5:
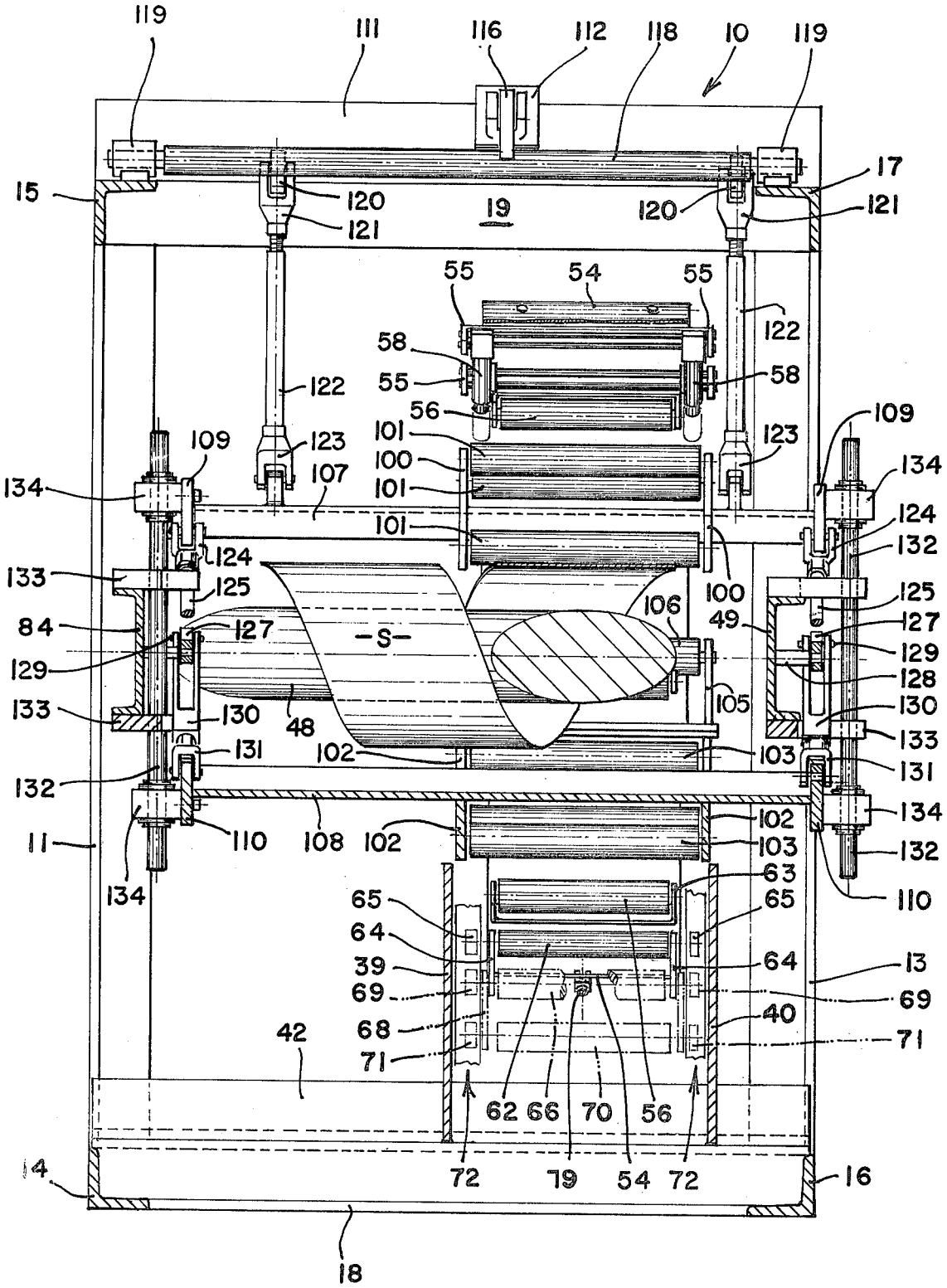
FIG. 5 is a sectional view taken substantially along line 5—5 of FIG. 1.

The strip accumulator according to the present invention is indicated generally by the numeral 10 and is shown in FIGS. 1 and 5 as having a main frame in the form of a box-like structure including vertically oriented angle irons 11, 12 and 13 (the fourth vertical angle irons not being shown) and several horizontal angle irons 14, 15, 16, 17, 18 and 19 (two horizontal angle irons not being shown) interconnecting the vertical angle irons at the tops and bottoms thereof to form the box-like frame. This frame carries, either directly or indirectly, the remaining portions of accumulator 10.

Accumulator 10 receives strip S, which may be of any material and gauge, but which is generally a metallic material, and which may be of any width, from an uncoiler (not shown) which carries a coil of strip S. The strip is threaded into accumulator 10 between guide rollers 20 and 21 carried between plates 22 (only one shown) that are supported by the frame. Strip S then passes through edge on guide assembly, indicated generally by the numeral 23, which includes four rollers 24 (two being shown) to align the strip laterally so that it may be properly received between pinch rolls 25 and 26. Roll 26 is carried between plates 28 (only one shown) which in turn is carried by the main frame. Roll 26 is driven by a motor (not shown) to provide the motive force drawing strip S into accumulator 10. Roll 25 is carried between plates 29 (only one shown) and is adjustably movable toward and away from drive roll 26 by an adjustment mechanism indicated generally by the numeral 30. Mechanism 30 is attached to plates 29 by means of angle iron 31 and includes an adjusting screw 32 and spring 33 so that the tension between rolls 25 and 26 may be adjusted in a conventional manner dependent on the gauge of the strip S.

The driven strip then passes between a wear plate 34 held by mounting plate 35 and a series of rollers 36 carried between plates 28. Strip S contacts additional rollers 38 mounted between mounting plates 39 and 40 (FIG. 5). Plates 39 and 40 are carried by angle irons 41 and 42 which extend between angle irons 14 and 16 of the main frame. In addition, plates 39 and 40 are each connected to their adjacent plate 28 by a splice bracket 43. As strip S is passed over rollers 38, side edge guides 44 (only one shown) carried by plates 39 and 40 assure that the strip is still laterally aligned.

Figure 2:
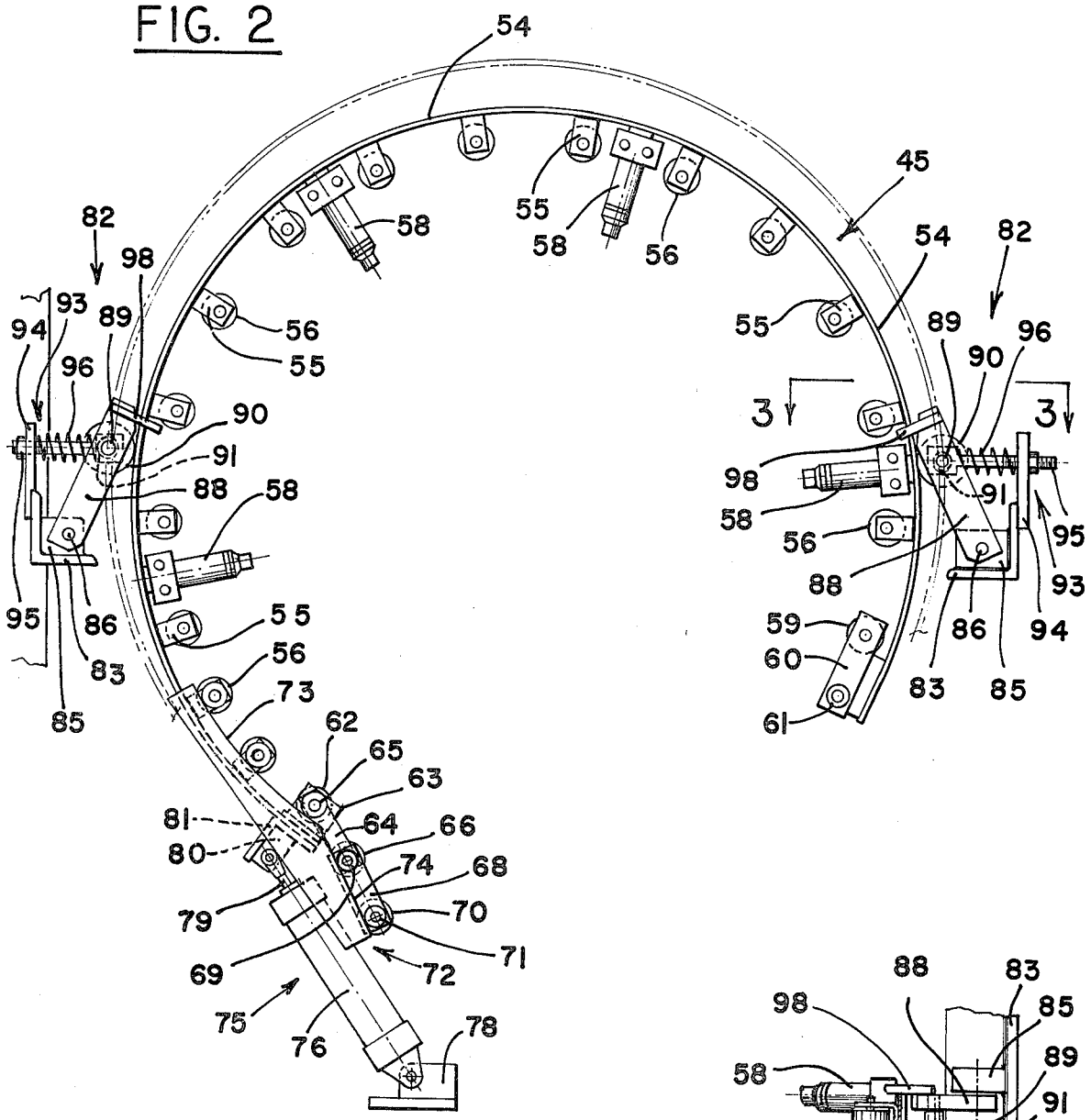
FIG. 2 is an elevational view of the outer convolution forming and supporting assembly shown in more detail than in FIG. 1.
Figure 4:
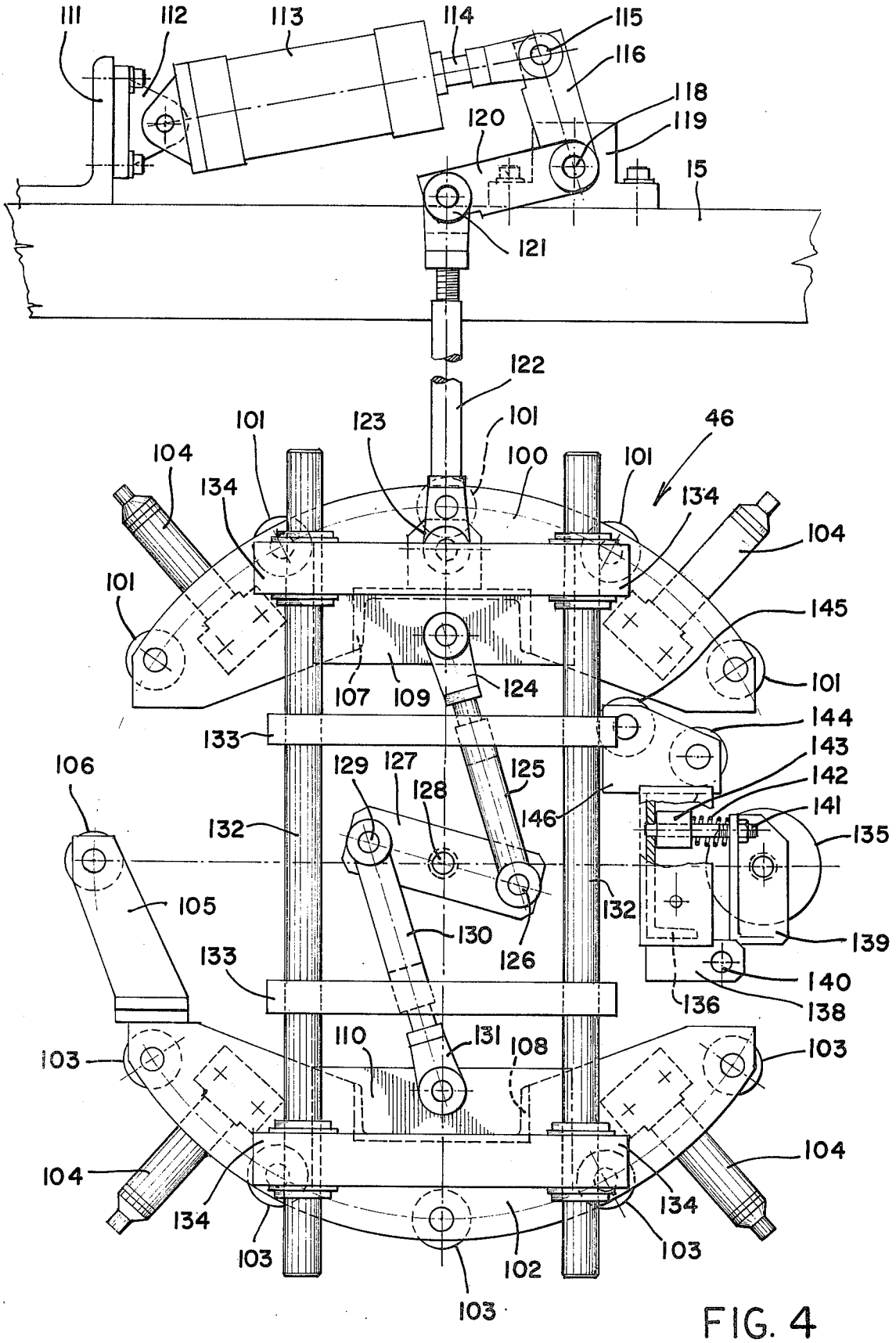
FIG. 4 is an elevational view of the inner convolution forming and supporting assembly shown in more detail than in FIG. 1.

Strip S then has a loop formed therein positioned between an outer convolution forming and support assembly indicated generally by the numeral 45 and shown in detail in FIG. 2, and an inner convolution forming and support assembly indicated generally by the numeral 46 and shown in detail in FIG. 4. As will hereinafter be described in detail, as strip is fed into accumulator 10, the loop between outer convolution support assembly 45 and inner convolution support assembly 46 orbits therebetween depositing a convolution of strip material on the inside of the outer assembly 45 and on the outer of the inner assembly 46.

As will also be described in detail, strip is removed from accumulator 10 from the inside convolution of inner assembly 46 and directed around a take-out arbor 48, omitted for clarity in FIG. 1 and shown schematically in FIG. 5. Take-out arbor 48 is mounted on rear crossbeam 49 supported by the main frame and serves the purpose of spiralling the strip out of the plane of the convolutions. A typical take-out arbor is shown in Costello, et al. U.S. Pat. No. 3,885,748 issued May 27, 1975 to which reference is made for whatever details are contained therein relative to the take-out arbor needed to understand the present invention. After passing around arbor 48, strip S leaves accumulator 10 through exit rolls 50 and 51 which are supported by plate 52, mounted between angles 53 that extend between angles 11 and 13 of the main frame.

With particular reference to FIG. 2, the outer convolution support assembly 45 will now be described in detail. Outer support assembly 45 includes a flexible expandable band 54 which, as will hereinafter be described, is bent to form a generally circular configuration. A plurality of generally U-shaped brackets 55 are mounted on band 54 and have branches which extend generally radially inward of the band to support both ends of a roller 56 therebetween. Rollers 56 are thus adapted to engage the first convolution of strip S thereon and together with band 54 support all the outer convolutions of strip material. Also mounted on band 54 are pairs of edge guide rollers 58 which extend radially inward of band 54, which are circumferentially spaced along the length of band 54 and which are mounted outside of the axial extent of rollers 56 to maintain the strip aligned on band 54. Rollers 58 may be adjustably mounted to accommodate strip of varying widths.

The last roller 59 on band 54 is mounted between elongate plates 60 (only one shown) which are also pin connected, as at 61, to a plate (not shown) which is adjustably connected to plate 28. Thus, pin 61 acts as the pivot point for band 54. As best seen in FIGS. 2 and 5, the first roller 62 on band 54 is mounted by a U-shaped bracket 63, similar to brackets 55. However, the axle of roller 62 extends through the radially inward directed branches of bracket 63 to engage one end of link arms 64 and terminate in roller bearings 65. The other end of link arms 64 carry a roller 66, the axle of which extends through link arms 64, one end of additional link arms 68, and terminates in roller bearings 69. The other end of link arms 68 carry a roller 70, the axle of which carries bearings 71. Bearings 65, 69 and 71 are adapted to ride on tracks indicated generally by the numeral 72, one track 72 being affixed to the inside of plate 39 and the other to the inside of plate 40. As shown in FIG. 1, each track 72 includes two arcuate surfaces 73 and 74. When roller bearings 69 and 71 are on surface 74, rollers 66 and 70 are out of the path of the strip material. However, as convolutions of strip material begin to build up on the inside of band 54 against rollers 56, the band begins to expand, in a manner to be hereinafter explained, and bearings 69 and 71 begin moving up surface 74 and onto surface 73 thereby permitting rollers 66 and 70 to contact the strip and add support thereto.

The expansion and/or contraction of band 54 is regulated by a control assembly generally indicated by the numeral 75 and shown in FIGS. 1 and 2. Control assembly 75 includes a pneumatic cylinder 76 connected to one end to a bracket 78 mounted on angle 14 and having its piston rod 79 clevis connected to a plate 80 welded to an angle iron 81. Angle 81 is affixed to the back of band 54 thus enabling cylinder 76 to control the expansion and/or contraction of the band. Dependent on the weight of the strip S, cylinder 76 may either be set to provide resistance to band expansion so that sudden expansion does not occur or can be set to actually create the expansion itself. Most often for heavy gauge strip, cylinder 76 will be set to resist or otherwise hold back expansion and for lighter gauge material it will promote or assist expansion. In addition, cylinder 76 will retract rod 79 when a previously full outer set of convolutions has been emptied to thereby return the band to its original position.

Figure 3:
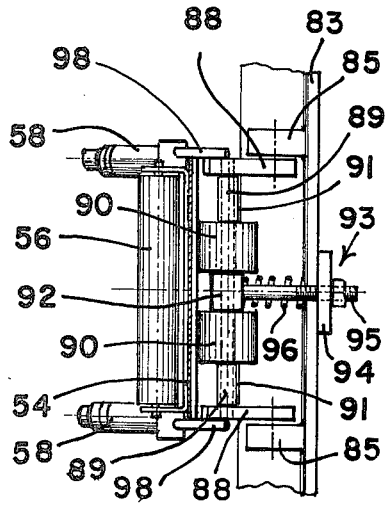
FIG. 3 is a sectional view taken substantially along line 3—3 of FIG. 2.

An additional band expansion control is provided by means of two band support and guide assemblies indicated generally by the numerals 82 and shown in detail in FIG. 3. Band support and guide assemblies 82 are carried by angle members 83 which extend between rear crossbeam 49 (FIG. 5) and front crossbeam 84 (FIGS. 1 and 5). Mounted on each angle member 83 are two pivot blocks 85 which have a pin member 86 journalled therein. Proximate each pivot block 85, pin member 86 carries pivot arms 88 which have a shaft 89 extending therebetween. Shaft 89 carries two stabilizer rolls 90 which are spaced from pivot arms 88 by sleeves 91 and spaced from each other by a block 92. Arms 88 are biased toward band 54 by a spring assembly indicated generally by the numeral 93 which includes a back-up plate 94 mounted on angle 83. A spring retainer 95 extends through plate 94 and holds a coil spring 96 between plate 94 and block 92. Thus, dependent on the tension of spring 96, rolls 90 are urged against band 54 to control and somewhat restrict the expansion thereof. In addition, the edges of band 54 are guided and stabilized by pin members 98 affixed to the side of pivot arms 88.

As convolutions of strip material build up against rollers 56, band 54 will begin to expand under the control of control assembly 75 including cylinder 76, and band support and guide assemblies 82. When expanded, band 54 will take on the configuration shown in chain lines in FIG. 2 with substantially every portion along the length thereof having a radial component of expansion. When fully expanded, rollers 66 and 70 will have moved along surfaces 74 and 73 of tracks 72 to complete the almost circular support. When the strip is withdrawn from the outer convolution support 45, cylinder 76 may retract the band to its original position shown in FIG. 2.

At the same time a convolution of strip is being deposited against outer convolution support 45, a convolution is being deposited against inner convolution support 46. As shown in FIGS. 4 and 5, inner convolution support 46 includes an upper crescent shaped frame member composed of two plates 100 having rollers 101 extending therebetween along the arcuate portion thereof. Similarly, support 46 includes a lower crescent shaped frame member composed of two plates 102 having rollers 103 extending therebetween along the arcuate portion thereof. Both plates also support strip edge guide rollers 104 much like rollers 58. In addition, plates 102 have brackets 105 affixed thereto to support an additional roller 106 to bridge the gap between rollers 101 and 103. Plates 100 and 102 are supported by channels 107 and 108, respectively. Channel 107 has end plates 109 affixed thereto and similarly channel 108 is provided with end plates 110.

Frame members 100 and 102 are movable toward and away from each other by means of an inner convolution support control assembly now to be described. An angle 111 extends between angle irons 15 and 17 of the main frame to support, through clevis bracket 112, a cylinder 113. The piston rod 114 of cylinder 113 is clevis connected, as at 115, to a link arm 116 which extends from a pivot shaft 118. Shaft 118 is mounted in journal bearings 119 carried by angle irons 15 and 17. Shaft 118 carries two additional link arms 120 which are spaced axially on shaft 118 from link arm 116 and extend at generally a right angle therefrom. The spacing of link arms 120 is such that one will be located on each side of the inner convolution support assembly 46, as shown in FIG. 5.

The outer ends of arms 120 are clevis connected, as at 121, to connecting rods 122 which are in turn clevis connected, as at 123, to channel 107 at two locations in front of and behind inner convolution support assembly 46. Channel 107 is clevis connected, as at 124, to yoke bars or linkages 125 which are each pin connected, as at 126, to actuator arms 127 which are pivoted on pins 128 connected to channels 49 and 84, respectively. The other end of each arm 127 is pin connected, as at 129, to second yoke bars or linkages 130 each of which are clevis connected, as at 131, to plates 110. Thus, as piston rod 114 is stroked, arms 120 pull channel 107 and the upper crescent shaped frames upwardly which through the linkage arrangements, 125, 127 and 130, move channel 108 and lower crescent shaped frames downwardly to expand the inner convolution support 46. Such movement is guided by rods 132 mounted on plates 133 carried by crossbeams 49 and 84, with rods 132 extending through bushings 134 mounted on plates 109 and 110.

Thus, as the inner convolution of strip adjacent rollers 101 and 103 is being fed around arbor 48 and to the processing line, cylinder 113 can control expansion of the inner convolution support assembly 46 to account for the strip material which has passed to the processing line. In order to feed strip from assembly 46 to arbor 48, a take-off roll 135 is provided to receive the first convolution of strip as it leaves the last roller 103. A channel 136 extends between crossbeams 49 and 84 and carries two pivot blocks 138 (only one shown). Roll 135 is mounted between upright flanges of a U-shaped plate 139 which has a shaft 140 affixed thereto which is received within the aperture of pivot block 138 to thus permit plate 139 to swing on the axis of shaft 140. Each of the upright flanges of plate 139 is slotted to receive a guide rod 141 for springs 142 (only one shown) which are situated between each upright flange of plate 139 and a bearing block 143 mounted on channel 136. Thus, roller 135 is biased outwardly and provides a cushioned take-off for the strip material which, as it leaves roller 135, will pass over rollers 144 and 145 mounted on frame 146 supported by channel 136. From roller 145, the strip is transferred around take-out arbor 48 and to the processing line.

In summary as to movement and storage of strip S in accumulator 10, strip is drawn in through pinch rolls 25 and 26, over rollers 36 and 38 and into the area between outer convolution support assembly 45 and inner convolution support assembly 46. When the strip is initially threaded into the accumulator, a loop is formed between assemblies 45 and 46 so that as strip is automatically drawn in, the loop will orbit in a clockwise direction in FIG. 1, depositing convolutions of strip against rollers 56 of the outer assembly and rollers 101, 103 and roller 106 of the inner assembly. As the convolutions build up, spacing between the inner and outer assemblies is maintained by the expansion of the outer assembly as regulated by the control assembly 75. If the processing line is demanding strip with accumulator 10 either filled or filling, the first convolution of strip resting against the inner assembly is drawn off around roll 135 and rollers 144 and 145, and directed around arbor 48 to exit between rolls 50 and 51. The inner assembly can then expand to account for the drawn out strip. The strip is at all times edge guided first by entry rollers 24, then by side edge guides 44 and finally by edge guide rollers 58 of the outer assembly and edge guide rollers 104 of the inner assembly.

It should thus be evident that an accumulator constructed according to the invention described herein will substantially improve the art by providing an efficient operating accumulator yet one which is manufactured, and controlled with far less moving parts than those of the prior art.

What is claimed is:

1. Apparatus for accumulating strip material comprising a frame support, means forming an outer set of convolutions of the strip material, and means forming an inner set of convolutions of the strip material, said means forming said outer set of convolutions including flexible band means defining the outer convolutions, roller means mounted on said band means to contact the first outer convolution of the strip material, and means supporting said band means on said frame support to permit expansion of said band means, the expansion having a radial component along substantially the entire length of said band means.

2. Apparatus according to claim 1 wherein said means supporting said band means includes means to mount one end of said band means on a pivot point from which said band means expands.

3. Apparatus according to claim 2 wherein said means supporting said band means further includes control means engaging the other end of said band means and controlling the expansion of said band means.

4. Apparatus according to claim 3 wherein said control means includes cylinder means which can selectively resist expansion of said band means or promote expansion of said band means and which can retract said band means once expanded.

5. Apparatus according to claim 1 further comprising additional roller means attached to one end of said band means, and track means to direct the movement of said roller means, said track means being configured to maintain said additional roller means out of contact with the strip material when said band means is fully contracted and in contact with the strip material when said band means is fully expanded.

6. Apparatus according to claim 1 further comprising means mounted on said band means to guide the edges of the strip material in said outer set of convolutions.

7. Apparatus according to claim 1 further comprising additional support means for said band means, said additional support means supporting said band means by engaging the outside of said band means and restricting expansion thereof.

8. Apparatus according to claim 7 wherein said additional support means includes pivotal roller means engaging said band means, and biasing means maintaining said pivotal roller means against said band means.

9. Apparatus according to claim 7 wherein said additional support means also guides the edge of said band means.

10. Apparatus according to claim 1 further comprising bracket means on said band means to support said roller means on both ends thereof.

11. Apparatus according to claim 1 wherein said means forming said inner set of convolutions includes first and second arcuate means carried by said frame support and defining the inner convolutions, second roller means mounted on said first and second arcuate means to contact the first inner convolution of the strip material, and control means to move said first and second arcuate means toward and away from each other.

12. Apparatus according to claim 11 wherein said first and second arcuate means each include two plate members, said second roller means being supported between said plate members.

13. Apparatus according to claim 11 further comprising means mounted on said first and second arcuate means to guide the edges of the strip material in said inner set of convolutions.

14. Apparatus according to claim 11 wherein said control means includes a rotatable shaft, means to rotate said shaft, means connecting said shaft to said first arcuate means so that upon rotation of said shaft said first arucate means moves in one direction, and linkage means connecting said first arcuate means to said second arcuate means so that upon rotation of said shaft said second arcuate means moves in the opposite direction of said first arcuate means.

15. Apparatus for accumulating strip material comprising a frame support, means forming an outer set of convolutions of the strip material, and means forming an inner set of convolutions of the strip material, said means forming said inner set of convolutions including first and second arcuate means carried by said frame support and defining the inner convolutions, roller means mounted on said first and second arcuate means to contact the first inner convolution of the strip material, and control means to move said first and second arcuate means toward and away from each other.

16. Apparatus according to claim 15 wherein said frist and second arcuate means each include two plate members, said roller means being supported between said plate members.

17. Apparatus according to claim 15 further comprising means mounted on said first and second arcuate means to guide the edges of the strip material in said inner set of convolutions.

18. Apparatus according to claim 15 wherein said control means includes a rotatable shaft, means to rotate said shaft, means connecting said shaft to said first arcuate means so that upon rotation of said shaft said first arcuate means moves in one direction, and linkage means connecting said first arcuate means to said second arcuate means so that upon rotation of said shaft said second arcuate means moves in the opposite direction of said first arcuate means.

19. Apparatus according to claim 15 wherein said means forming said outer set of convolutions includes flexible band means defining the outer convolutions, second roller means mounted on said band means to contact the first outer convolution of the strip material, means mounting one end of said band means on a pivot point from which the band expands, and control means engaging the other end of said band means to control the expansion thereof, said expansion having a radial component along substantially the entire length of said band means.

20. Apparatus according to claim 15 further comprising take-out arbor means mounted generally centrally of said inner set of convolutions and receiving the strip material from the inner set of convolutions, and second roller means guiding the strip material from said inner set of convolutions to said arbor means.

* * * * *